United States Patent [19]

Shekleton

[11] Patent Number: 4,930,306

[45] Date of Patent: Jun. 5, 1990

[54] REDUCING CARBON BUILDUP IN A TURBINE ENGINE

[75] Inventor: Jack R. Shekleton, San Diego, Calif.

[73] Assignee: Sundstrand Corporation, Rockford, Ill.

[21] Appl. No.: 199,246

[22] Filed: May 26, 1988

[51] Int. Cl.[5] ..... F23R 3/54

[52] U.S. Cl. ..... 60/39.36; 60/756

[58] Field of Search ..... 60/39.36, 756, 754, 60/755

[56] References Cited

U.S. PATENT DOCUMENTS

| | | | |
|---|---|---|---|
| 2,545,495 | 3/1951 | Sforzini | 60/756 |
| 2,699,648 | 1/1955 | Berkey | 60/756 |
| 3,613,360 | 10/1971 | Howes . | |
| 3,808,803 | 5/1974 | Salvi | 60/737 |
| 4,695,247 | 9/1987 | Enzaki et al. | 60/756 |

*Primary Examiner*—Carlton R. Croyle
*Assistant Examiner*—Timothy S. Thorpe
*Attorney, Agent, or Firm*—Wood, Dalton, Phillips, Mason & Rowe

[57] ABSTRACT

Carbon buildup in a turbine engine including a compressor 16 coupled to a turbine wheel 22 mounted for rotation about an axis and having a nozzle 24 disposed to direct gas at the turbine wheel 22 to drive the same, an annular combustor 26 disposed about the axis and in fluid communication with the nozzle 24 and having a radially inner wall 32, a radially outer wall 34 and a generally radially extending wall 46, a plurality of fuel injectors 48, a compressed air plenum 42, 44, 45 surrounding the combustor 26, a plurality of circumferentially spaced apertures 66 in the radial wall 34 and a cooling strip 68 for directing air passing through the apertures 66 along the radial wall 39 is reduced by locating the apertures 66 closely adjacent the radially outer part of the radial wall 39 and locating the cooling strips 68 to direct air passing through the apertures 66 inwardly as at 72 along the radial wall 39.

4 Claims, 2 Drawing Sheets

REDUCING CARBON BUILDUP IN A TURBINE ENGINE

FIELD OF THE INVENTION

This invention relates to turbine engines, and more specifically, to an improvement whereby carbon buildup in the combustor of a turbine engine may be substantially reduced.

BACKGROUND OF THE INVENTION

Turbine engines driven by gases of combustion resulting from the burning of carbonaceous fuels commonly suffer the problem of so-called carbon buildup. Such engines typically include one or more combustors in which carbonaceous fuel is combusted with an oxidant, most usually air, to produce hot gases of combustion. Most frequently, the hot gases of combustion are diluted with cooler air and then applied to a nozzle which in turn directs the gases against the turbine wheel to drive the same.

During the combustion process, there is a tendency for carbon buildup to occur as a result of incomplete combustion. While such is undesirable from the standpoint that incomplete combustion reduces the efficiency of operation of the turbine, it is even more undesirable from the standpoint that as the buildup occurs, pieces of carbon at the buildup will break off and be swept through the nozzle and the turbine wheel with the hot gases of combustion. This particulate carbon causes erosion of the nozzle as it passes therethrough as well as erosion of the blades of the turbine wheel. Consequently, the break up of carbon buildup reduces the life of the turbine engine by increasing the wear rate of the nozzle and the turbine wheel.

The present invention is directed to overcoming one or more of the above problems.

SUMMARY OF THE INVENTION

It is the principal object of the invention to provide a new and improved turbine engine. More specifically, it is an object of the invention to provide an improvement for a turbine engine that substantially reduces carbon buildup therein to minimize the problems associated therewith.

An exemplary embodiment of the inventive means for reducing carbon buildup is applied to a turbine engine of the type having a compressor coupled to a turbine wheel and mounted for rotation about an axis. A nozzle is disposed to direct gas at the turbine wheel to drive the same and an annular combustor is disposed about the axis in fluid communication with the nozzle. The annular combustor has a radially inner wall, a radially outer wall, and a generally radially extending wall interconnecting the inner and outer walls at a location opposite the nozzle. Fuel injectors for injecting carbonaceous fuel generally axially between the inner and outer walls near the radial wall are provided and a compressed air plenum is in fluid communication with the compressor and surrounds the walls of the combustor in generally spaced relation. A plurality of circumferentially spaced apertures are disposed in the radial wall of the combustor to provide for the flow of cooling air from the plenum to the interior of the combustor and a cooling strip is located within the combustor for directing air passing through the apertures along the radial wall.

The invention contemplates the specific improvement of a means for substantially reducing carbon buildup within the combustor by locating the apertures closely adjacent the radially outer part of the radial wall with the cooling strip being located to direct air passing through the apertures inwardly along the radial wall.

According to one embodiment of the invention, the cooling strip may include a section spaced from and nominally parallel to the radial wall near the apertures and the section is provided with a plurality of apertures of smaller size and greater in number than the apertures in the radial wall.

The invention also contemplates that the cooling strip include a base section in abutment with one of the walls and additional apertures extending through the base section and the one wall at the point of such abutment.

Other objects and advantages will become apparent from the following specification taken in connection with the accompanying drawings.

DESCRIPTION OF THE PREFERRED EMBODIMENT

Figure 1:
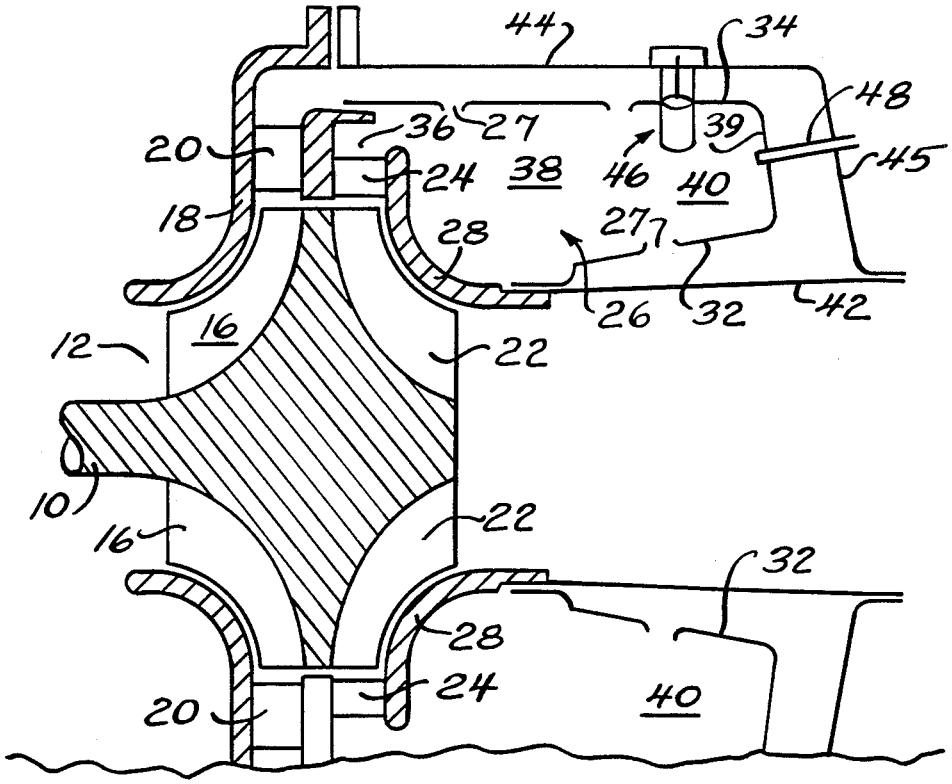
FIG. 1 is a somewhat schematic, sectional view of a turbine engine in which the inventive improvement may be advantageously incorporated.

An exemplary embodiment of a gas turbine made according to the invention is illustrated in the drawings in the form of a radial flow, air breathing gas turbine. However, the invention is not limited to radial flow turbines and may have applicability to any form of air breathing turbine having an annular combustor.

The turbine includes a rotary shaft 10 journaled by bearings not shown. Adjacent one end of the shaft 10 is an inlet area 12. The shaft 10 mounts a rotor, generally designated 14, which may be of conventional construction. Accordingly, the same includes a plurality of compressor blades 16 adjacent the inlet 12. A compressor blade shroud 18 is provided in adjacency thereto and just radially outwardly of the radially outer extremities of the compressor blades 18 is a conventional diffuser 20.

Oppositely of the compressor blades 16, the rotor 14 has a plurality of turbine blades 22. There is thus defined a compressor coupled to a turbine wheel. Just radially outwardly of the turbine blades 22 is an annular nozzle 24 which is adapted to receive hot gasses of combustion from an annular combustor, generally designated 26. The compressor system including the blades 16, shroud 18 and diffuser 20 delivers hot air to the annular combustor 26, and via dilution air passages 27, to the nozzle 24 along with the gasses of combustion. That is to say, hot gasses of combustion from the combustor are directed via the nozzle 24 against the blades 22 to cause rotation of the rotor 14, and thus the shaft 10. The latter may be, of course, coupled to some sort of apparatus requiring the performance of useful work.

A turbine blade shroud 28 is interfitted with the combustor 26 to close off the flow path from the nozzle 24 and confine the expanding gas to the area of the turbine blades 22.

The combustor 26 has a generally cylindrical radially inner wall 32, and a generally cylindrical radially outer wall 34. The two are concentric and merge to a necked down area 36 which serves as an outlet from an interior annulus 38 of the combustor 26 to the nozzle 24. A third wall 39, generally concentric with the walls 32 and 34, extends generally radially to interconnect the walls 32 and 34 and to further define the annulus 38.

Opposite of the outlet 36 and adjacent the wall 39, the interior annulus 38 of the combustor 26 includes a primary combustion zone 40 in which the burning of fuel primarily occurs. Other combustion may, in some instances, occur downstream from the primary combustion area 40 in the direction of the outlet 36. As mentioned earlier, provision is made for the injection of dilution air through the passages 27 into the combustor 26 downstream of the primary combustion zone 40 to cool the gasses of combustion to a temperature suitable for application to the turbine blades 22 via the nozzle 24.

In any event, it will be seen that the primary combustion zone 40 is an annulus or annular space defined by the generally radially inner wall 32, the generally radially outer wall 34 and the radial wall 39.

Further walls 42 and 44 generally concentric to the walls 32 and 34 are located radially inwardly and radially outwardly of the latter along with an additional, generally radially extending wall 45 to provide a manifold or compressed air plenum. The plenum thus defined surrounds, in spaced relation, the combustor 26. The wall 44 extends to the outlet of the diffuser 20 and thus serves to contain and direct compressed air from the compressor to the combustor 26. Mounted on the wall 44, and extending through the wall 34 is, for example, an ignition device 46. Finally, a plurality of fuel injectors for carbonaceous fuel, shown somewhat schematically at 48, inject fuel generally axially into the annulus 38. As can be seen from FIG. 1, the stream of injected fuel may also be directed slightly radially inwardly as well.

Figure 4:
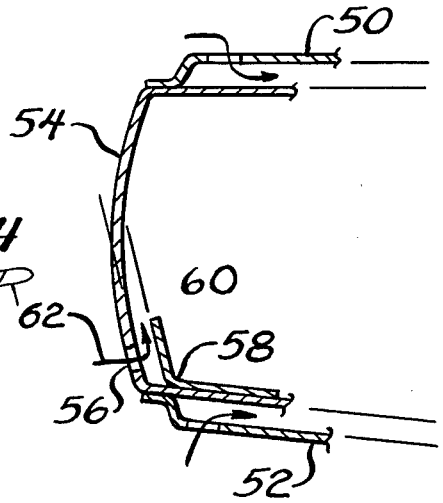
FIG. 4 PRIOR ART
FIG. 4 is a view similar to FIG. 3 but of a prior art combustor.

The construction just described is generally that of the turbine engine manufactured by the assignee of the present application and sold under the trademark "TITAN". A somewhat more detailed showing of part of the construction of the combustor 26 in the "TITAN" is illustrated in FIG. 4. There, the radially outer wall of the combustor is designated 50 while the radially inner wall is designated 52. The radial wall is designated 54 and is seen to include a circular row of apertures 56 (only one of which is shown) at the radially inner extremity of the radial wall 54. A cooling strip 58 includes a radially outwardly directed section 60 that is nominally parallel to the radial wall 54 near and overlying the apertures 56 so as to direct air flow generally radially outwardly as shown by an arrow 62. In practice, this has resulted in a substantial accumulation of carbon or carbon buildup on the side of the cooling strip 58 opposite the row of apertures 56.

Figure 2:
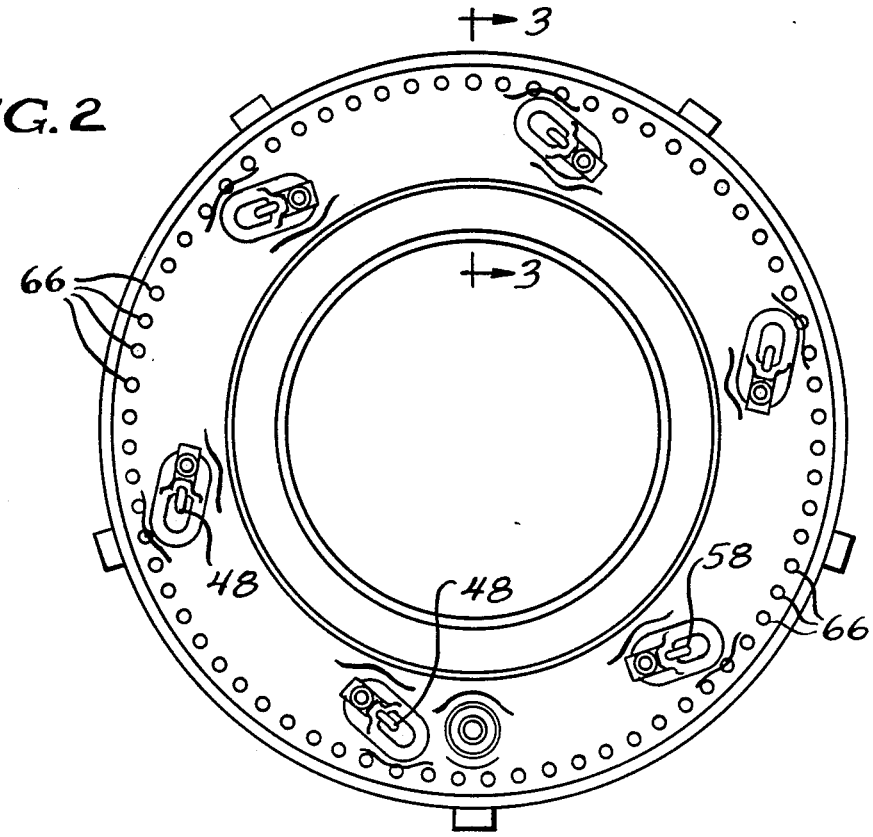
FIG. 2 is an elevational view of a combustor made according to the invention.
Figure 3:
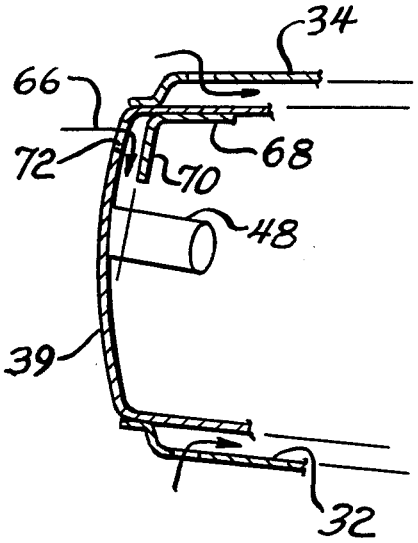
FIG. 3 is an enlarged, fragmentary sectional view of the combustor taken approximately along the line 3—3 in FIG. 2.

According to the invention, and as seen in FIGS. 2 and 3, the row of apertures 56 and the cooling strip 58 are omitted. Thus, the radially inner part of the radial wall 39 is free of the apertures 56 and the cooling strip 58. Rather, to provide for cooling of the radial wall 39, a circular row of axially opening apertures 66 are located in the radial wall 39 near its radially outer extremity. A cooling strip 68 is mounted adjacent the radially outer wall 34 so as to provide a section 70 which is nominally parallel to the radial wall 39 in spaced overlying relation to the apertures 66 and which is directed radially inward. As a consequence, air from the plenum surrounding the combustor 26 flows through the apertures 66 and radially inward along the wall 39 for cooling purposes as illustrated by an arrow 72.

Quite unexpectedly, practice has shown that the relocation of the row of apertures to the radially outer part of the radial wall 39 and commensurate relocation and reorientation of the associated cooling strip has resulted in a reduction in carbon buildup on the order of 65%. As a consequence, there is a substantial reduction of carbon particles flowing through the nozzle 24 and against the turbine blades 22, and a commensurate decrease in the wear rate that results from erosion by particulate carbon.

Figure 5:
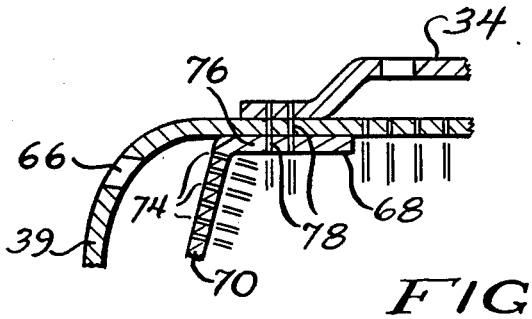
FIG. 5 is an enlarged, fragmentary sectional view of a modified embodiment of the invention.

A further reduction in carbon buildup can be obtained through use of the embodiment illustrated in FIG. 5. In the embodiment illustrated in FIG. 5, the section 70 of the cooling strip 68 is provided with a plurality of extremely small apertures 74. The apertures 74 are smaller than the apertures 66 and in an overall combustor, there is a substantial greater number of the apertures 74 than apertures 66. As a consequence, there will be a small air flow through the apertures 74 in the direction moving away from the radial wall 39. This air movement tends to sweep the downstream side of the cooling strip 68 to prevent carbon buildup.

If desired, a base section 76 of the cooling strip 68 which is essentially mounted to the radially outer wall 34 as illustrated in FIG. 5 may be provided with apertures 78 generally similar in size to the apertures 74 and which also extend through the radially outer wall 34. This provides additional sweeping action.

It bears repeating that the relocation of the cooling air apertures in the radial wall 39 of the combustor 26 produces a reduction in carbon buildup within the combustor on the order of 65%. Thus, the invention, through a relatively simple and easily executed, inexpensive improvement, quite unexpected achieves a substantial reduction of carbon buildup and the problems associated therewith.

I claim:

1. In a turbine engine including a compressor coupled to a turbine wheel and mounted for rotation about an axis, a nozzle disposed to direct gas at said turbine wheel to drive the same; an annular combustor disposed about said axis in fluid communication with said nozzle and having a radially inner wall, a radially outer wall and a generally radially extending wall interconnecting said inner and outer walls at a location opposite said nozzle, a plurality of fuel injectors for injecting carbonaceous fuel generally axially between said inner and outer walls near said radial wall, a compressed air plenum in fluid communication with said compressor and surrounding said walls of said combustor in generally spaced relation, a plurality of circumferentially spaced apertures in said radial wall to provide for the flow of cooling air from said plenum to the interior of the combustor, and a cooling strip within said combustor for directing air passing through said apertures along said radial wall, the improvement for substantially reducing carbon buildup within said combustor wherein said apertures are located closely adjacent the radially outer part of said radial wall and said cooling strip is located to direct air passing through said apertures radially inwardly along said radial wall; the radially inner part of said radial wall being free of said apertures and said cooling strips.

2. The turbine engine of claim 1 wherein said cooling strip includes a section spaced from and nominally parallel to said radial wall near said apertures, said section having a plurality of apertures of smaller size and of greater number than the apertures in said radial wall.

3. The turbine engine of claim 1 wherein said cooling strip includes a base section in abutment with one of said walls, and additional apertures extending through said base section and said one wall at the point of said abutment.

4. In a turbine engine including a compressor coupled to a radial inflow turbine wheel and mounted for rotation about an axis, an annular nozzle surrounding said turbine wheel to direct gas thereat to drive the same; an annular combustor disposed about said axis in fluid communication with said nozzle and having a radially inner wall, a radially outer wall and a generally radially extending wall interconnecting said inner and outer walls at a location opposite said nozzle, a plurality of fuel injectors for injecting carbonaceous fuel generally axially and somewhat radially inwardly between said inner and outer walls near said radial wall, a compressed air plenum in fluid communication with said compressor and surrounding said walls of said combustor in generally spaced relation, a plurality of circumferentially spaced apertures in said radial wall to provide for the flow of cooling air from said plenum to the interior of the combustor, and a cooling strip within said combustor for directing air passing through said apertures along said radial wall, the improvement for substantially reducing carbon buildup within said combustor wherein said apertures are located in an axially opening circular row closely adjacent the radially outer part of said radial wall and said cooling strip has a radially oriented section overlying said apertures to direct air passing through said apertures radially inwardly along said radial wall; the radially inner part of said radial wall being free of said apertures and said cooling strips.

* * * * *